US006481716B2

(12) United States Patent
Trice

(10) Patent No.: US 6,481,716 B2
(45) Date of Patent: Nov. 19, 2002

(54) METHOD OF PLAYING A VARIANT OF CHESS

(76) Inventor: Edward A. Trice, 1201 Bethlehem Pike, No. 105, North Wales, PA (US) 19454

( * ) Notice: Subject to any disclaimer, the term of this patent is extended or adjusted under 35 U.S.C. 154(b) by 0 days.

(21) Appl. No.: 09/858,361

(22) Filed: May 16, 2001

(65) Prior Publication Data

US 2002/0109296 A1 Aug. 15, 2002

Related U.S. Application Data

(60) Provisional application No. 60/628,190, filed on Feb. 12, 2001.

(51) Int. Cl.[7] ..... A63F 3/02
(52) U.S. Cl. ..... 273/260; 273/242; 273/243
(58) Field of Search ..... 273/260, 261, 273/242, 243

(56) References Cited

U.S. PATENT DOCUMENTS

| | | | | | |
|---|---|---|---|---|---|
| 4,033,586 | A | * | 7/1977 | Corinthios | 273/131 K |
| RE32,716 | E | * | 7/1988 | Corinthios | 273/260 |
| 5,690,334 | A | * | 11/1997 | Duke | 273/261 |
| 5,692,754 | A | * | 12/1997 | Rostami | 273/261 |
| 6,095,523 | A | | 8/2000 | Lampman | 273/260 |
| 6,116,602 | A | | 9/2000 | McLoy | 273/261 |
| 6,336,632 | B1 | | 1/2002 | London | 273/261 |

FOREIGN PATENT DOCUMENTS

| | | |
|---|---|---|
| FR | 2 435 269 | 4/1980 |

OTHER PUBLICATIONS

John Gollon, Chess Variations Ancient, Regional and Modern, 1968 Charles E. Tuttle Company, Inc. Chapter 30, pp. 219–222 and Chapter 34, pp. 230–233.*
<<www.chessvariants.com>>.*

* cited by examiner

*Primary Examiner*—Valencia Martin-Wallace
*Assistant Examiner*—Alex F. R. P. Rada, II
(74) *Attorney, Agent, or Firm*—Drinker Biddle & Reath LLP

(57) ABSTRACT

A method of playing a variant of chess that provides a rectangular chessboard having 80 contiguous playing squares disposed thereon. A plurality of conventional chess pieces that include two rooks, two bishops, two knights, a king, a queen, and eight pawns are provided for each player. A plurality of non-conventional chess pieces that include a chancellor, an archbishop, and two additional pawns are provided for each player. The conventional and non-conventional pieces are initially located on two rows of the rectangular chessboard that are disposed most proximate to each of the two player edges. After the initially locating step, the chancellor may be moved, at an option of a player, as either a conventional knight, or a conventional rook. After the initially locating step, the archbishop may be moved, at an option of a player, as a conventional knight or a conventional bishop.

17 Claims, 10 Drawing Sheets

METHOD OF PLAYING A VARIANT OF CHESS

CROSS REFERENCE TO RELATED APPLICATION

This application claims priority from Provisional Application No. 60/268,190 entitled, "80 Square Variation of Chess", filed Feb. 12, 2001, incorporated herein by reference.

FIELD OF THE INVENTION

This invention relates to chess games, and more particularly to a variation of a chess game.

BACKGROUND OF THE INVENTION

Without a doubt, former World Champion (1921–1927) Jose Capablanca was a phenomenal chess player. Although a term like "genius" is often blearily bestowed to infranacious recipients, Capablanca surely exceeded all such criteria, which merit this adornment by orders of magnitude in the chess domain.

Capablanca's vision of what was coined the "state of chess" extended the bounds of his own lifetime by at least 50 years. In the 1920's, Master players were achieving draws roughly 25% of the time against members of their own class. Perhaps this lead to the eventual manifestation of the euphemism:

"The result of a game well-played is a draw".

In direct consequence to the increasing frequency of draws, chess time controls were lengthened. Since the end of World War II, longer secondary, and eventually tertiary temporal controls, have become status quo. Games previously lasting a couple of hours could now traverse one-fourth of a day or longer. This prompted Edward Lasker, as early as 1949, to issue the remark:

"We have reached a point where physical fitness and thorough knowledge of analyzed play are apt to decide the outcome of a match between front-rank chess masters, rather than ingenuity and profundity."

In the year 2000, it is not uncommon for Grandmasters to peacefully conclude a game as a draw, as early as the twelfth move. This is basically a mutual concession that the yet unplayed lines, well-known by both, perhaps even in a variation contested against each other in a previous encounter, offer nothing but the promise of several hours of trying to find what is not there; i.e. something new that is also worthy of testing. There are, of course, an infinitude of lines to avoid, that have not been played (all for good reason), so while these would be 'new', we naturally exclude them as 'unworthy to test' in tournament play.

It would be beneficial to provide a variation of chess that reaches beyond the traditional 8×8 chessboard and cast of pieces. One that will challenge the grand masters now and 50 years into the future.

SUMMARY OF THE INVENTION

The present invention is directed to a method of playing a variation of chess. The method comprises the step of providing a rectangular chessboard having 80 contiguous playing squares disposed thereon. The rectangular board includes two player edges that are opposite each other and two non-player edges that are adjacent to the two player edges. The board has a–j contiguous columns that are aligned along each of the player edges and 1–8 contiguous rows that are aligned along each of the two non-player edges.

The method further comprises the step of providing a plurality of conventional chess pieces. The plurality of conventional chess pieces include two Rooks, two Bishops, two Knights, a King, a Queen, and eight Pawns for each player. The method also comprises the step of providing a plurality of non-conventional chess pieces. The plurality of non-conventional chess pieces include a Chancellor, an Archbishop, and two additional Pawns for each player.

The method includes the step of initially locating the conventional and non-conventional pieces on the two rows of the rectangular chess board that are disposed most proximate to each of the two player edges. The Rooks are located at column and row positions a1, j1, a8, and j8 respectively. The Knights are located at positions b1, i1, b8, and i8 respectively. The Bishops are located at positions c1, h1, c8 and h8 respectively. The Queens are located at positions d1, d8 respectively. The Kings are located at positions f1, f8 respectively. The Archbishops are located at positions g1, g8 respectively. The Pawns are located at positions (a–j)2, (a–j)7 respectively. After the initially locating step, the Chancellor may be moved, at an option of a player, as either a conventional Knight, or a conventional Rook and the Archbishop may be moved, at an option of a player, as a conventional Knight or a conventional Bishop.

BRIEF DESCRIPTION OF THE DRAWINGS

The accompanying drawings, which are incorporated herein and constitute part of this specification, illustrate the presently preferred embodiment of the invention, and, together with the general description given above and the detailed description given below, serve to explain features of the invention. In the Figures.

DETAILED DESCRIPTION OF THE PREFERRED EMBODIMENT

Figure 1:
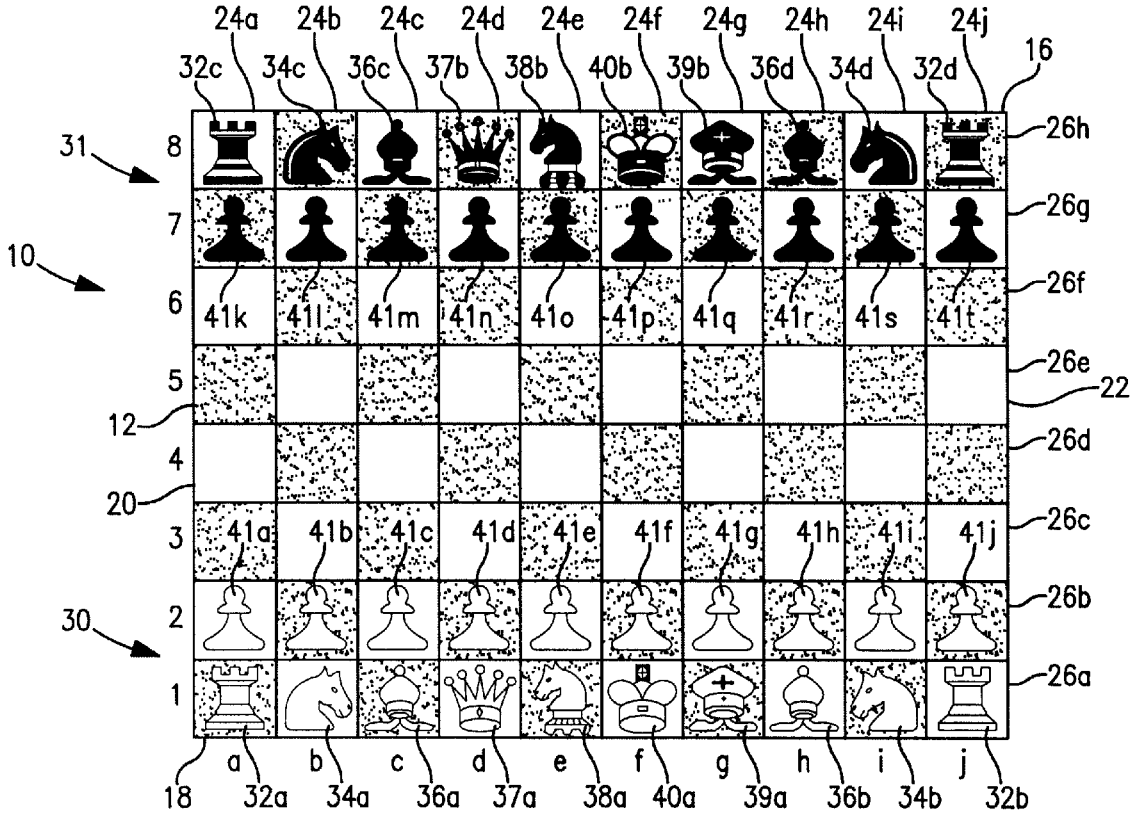
FIG. 1 is a diagram of the arrangement of the chessboard and pieces according to the present invention.

There is shown in FIG. 1, a diagram of an arrangement 10 for playing a variation of chess according to the present invention. The arrangement 10 includes a chessboard 12 that is rectangular in shape. The board 12 is comprised by 80 contiguous playing squares that are represented by the matrix (a1–j8) as shown. The board 12 includes two player edges 16 and 18 that are opposite each other and two non-player edges 20 and 22 that are adjacent to the two player edges 16 and 18 respectively. There are ten contiguous columns 24(a–j) that are aligned along each of the player edges 16 and 18, and there are eight contiguous rows 26(a–h) that are aligned along each of the two non-player edges 20 and 22.

A color is associated with each one of a corresponding set of pieces 30 and 31. The color white is associated with the pieces 30 that are initially positioned on squares (a–j)1 and (a–j)2. The color black is associated with the pieces 31 that are initially positioned on squares (a–j)7 and (a–j)8. A plurality of conventional pieces are provided to each player. The white conventional pieces include, two Rooks 32*a* and 32*b*, two Bishops 36*a* and 36*b*, two Knights 34*a* and 34*b*, a King 40*a*, a Queen 37*a*, and eight Pawns 41*a*, 41*b*, 41*c*, 41*d*, 41*f*, 41*h*, 41*i* and 41*j*. The black conventional pieces include, two Rooks 32*c* and 32*d*, two Bishops 36*c* and 32*d*, two Knights 34*c* and 34*d*,a King 40*b*, a Queen 37*b*, and eight Pawns 41*k*, 41*l*, 41*m*, 41*n*, 41*p*, 41*r*, 41*s* and 41*t*. A plurality of non-conventional chess pieces are provided to each player. The white non-conventional chess pieces include, a Chancellor 38*a*, an Archbishop 39*a* and two additional Pawns 41*e* and 41*g*. The black non-conventional chess pieces include, a Chancellor 38*b*, an Archbishop 39*b* and two additional Pawns 41(0) and 41*q*.

The conventional and non-conventional pieces are initially located on the two rows of the rectangular chess board 12 that are disposed most proximate to each of the two player edges 16 and 18. The Rooks 32*a*, 32*b*, 32*c* and 32*d* are located at column and row positions a1,j1, a8, and j8 respectively. The Knights 34*a*, 32*b*, 32*c* and 34*d* are located at positions b1, i1, b8, and i8 respectively. The Bishops 36*a*, 36*b*, 36*c* and 36*d* are located at positions c1, h1, c8 and h8 respectively. The Queens 37*a* and 37*b* are located at positions d1, d8 respectively. The Kings 40*a* and 40*b* are located at positions f1, f8 respectively. The Archbishops 39*a* and 39*b* are located at positions g1, g8 respectively. The Pawns 41*a*–41*j* and 41*k*–41*t* are located at positions (a–j)2 and (a–j)7 respectively.

In general, there are two types of moves that can be made on the board 12: those that capture other pieces, and those that do not do capture other pieces. Captures are executed when a piece of one color moves to occupy the same square of another color. The Kings 40*a* and 40*b* are the only pieces that may not be captured and taken off of the board. Because of this, when one of the Kings 40*a* or 40*b* is being attacked by an enemy piece, it is said to be in check. The descriptions to follow identify how each type of piece moves.

Figure 2:
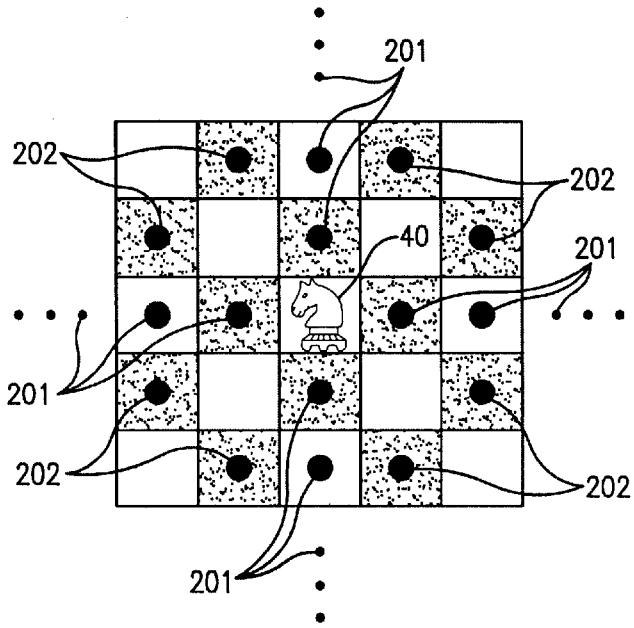
FIG. 2 is a diagram of the chessboard and the Chancellor, showing movement of the Chancellor on the chessboard, according to the present invention.

The black dots in FIG. 2 illustrate the allowed movement of the Chancellors 40*a* and 40*b* during any single turn in the present invention. The Chancellors 40*a* and 40*b* have the combined power of a conventional Rook or a conventional Knight. The Chancellors 40*a* and 40*b* thus may be moved, at an option of a player, any number of squares 201 horizontally or vertically that are vacant in the open playing field, or, at the player's option, to any square 302 that can be reached via jumping like a conventional Knight.

Figure 3:
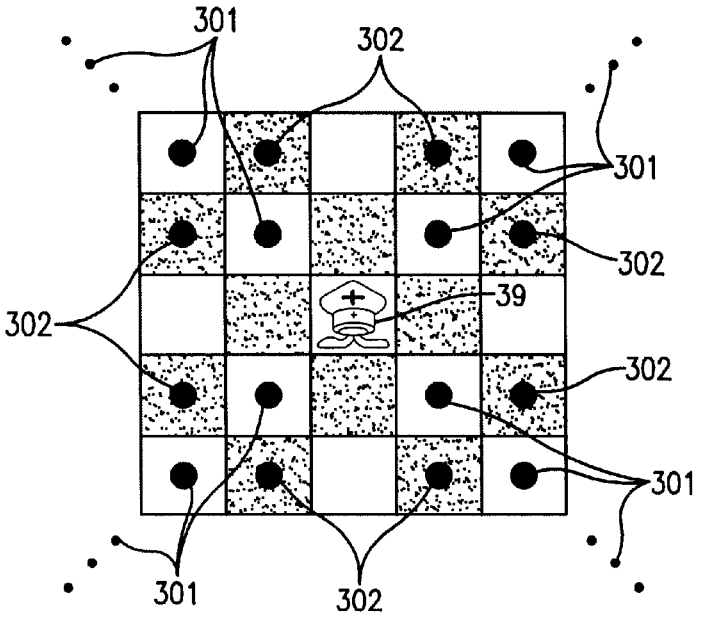
FIG. 3 is a diagram of the chessboard and the Archbishop, showing movement of the Archbishop on the chessboard, according to the present invention.

The black dots in FIG. 3 illustrate the allowed movement of the Archbishops 39*a* and 39*b* during any single turn in the present invention. The Archbishops 39*a* and 39*b* have the combined power of a conventional Bishop or a conventional Knight. The Archbishops 39*a* and 39*b* may be moved, at an option of a player, any number of squares 301 diagonally that are vacant in the open playing field, or, at the player's option, to any square 302 that can be reached via jumping like a conventional Knight.

Figure 4:
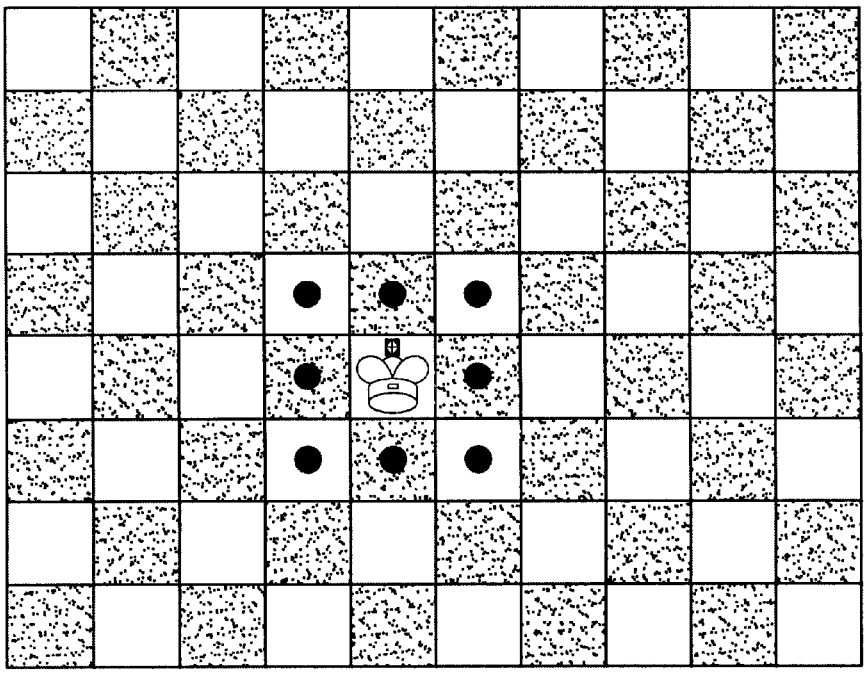
FIG. 4 is a diagram of the chessboard and the King, showing movement of the King on the chessboard, according to the present invention.

The black dots in FIG. 4 illustrate the allowed movement of the Kings 40*a* and 40*b* during any single turn in the present invention. The Kings 40*a* and 40*b* are the most important piece on the board, and move generally (except during castling) as conventional chess Kings. The Kings 40*a* and 40*b* are allowed to move one square in any direction that is open on the playing field. Later in the disclosure, it will be shown that another special move, called castling, is also available to the Kings 40*a* or 40*b* under certain circumstances. Another rule states that the Kings 40*a* and 40*b* are not allowed to be next to one other.

Figure 5:
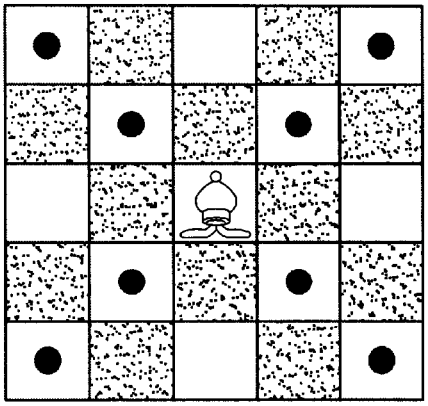
FIG. 5 is a diagram of the chessboard and the Bishop, showing movement of the Bishop on the chessboard, according to the present invention.

FIG. 5 illustrates movement of the Bishops 36*a*–36*d*, which move generally as conventional chess Bishops. The Bishops 36*a*–36*d* move diagonally as many squares that are unoccupied in the direction of movement. As shown in FIG. 5, the Bishops 36*a*–36*d*, in the open playing field, have four different diagonal directions to which they can move. On any turn, the Bishops 36*a*–36*d* may move along any one of these paths.

Figure 6:
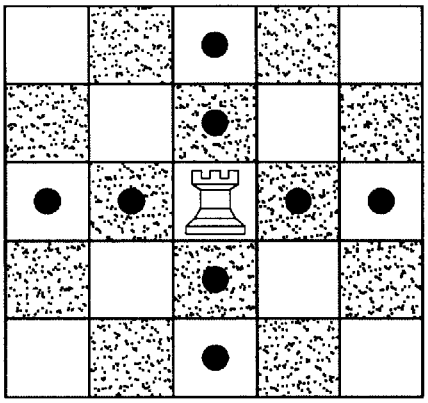
FIG. 6 is a diagram of the chessboard and the Rook, showing movement of the Rook on the chessboard, according to the present invention.

FIG. 6 illustrates the movement of the Rooks 32*a*–32*d*, which move generally as conventional chess Rooks. The Rooks 32*a*–32*d* move horizontally or vertically as many squares that are unoccupied in the direction of movement. As shown in FIG. 6, the Rooks 32*a*–32*d*, in the open playing field, have four different directions to which they can move. On any turn, the Rooks 32*a*–32*d* may move along any one of these paths.

Figure 7:
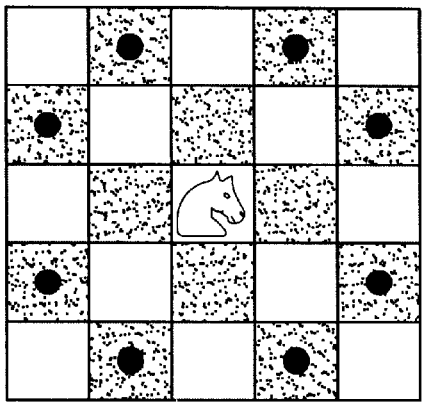
FIG. 7 is a diagram of the chessboard and the Knight, showing movement of the Knight on the chessboard, according to the present invention.

FIG. 7 illustrates the movement of the Knights 34*a*–34*d*, which move generally as conventional chess Knights. The Knights 34*a*–34*d* are allowed to "jump over" pieces, as it makes it moves. The Knights 34*a*–34*d* form an "L" by moving in two stages. First, horizontally or vertically two squares, and second, one square perpendicular to the previous movement. A typical way to describe one of the eight ways the Knights 34*a*–34*d* can move is "2 up, and 1 left".

Figure 8:
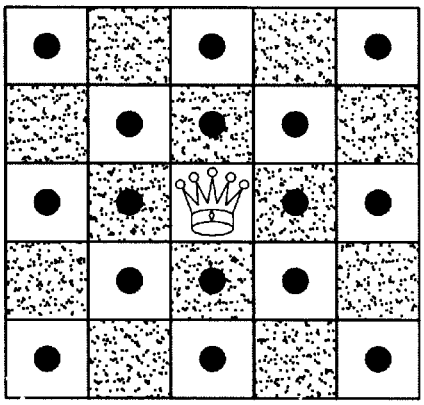
FIG. 8 is a diagram of the chessboard and the Queen, showing movement of the Queen on the chessboard, according to the present invention.

FIG. 8 illustrates the movement of the Queens 37*a* and 37*b*, which move generally as conventional chess Queens. The Queens 37*a* and 37*b* have the combined power of a Rook and Bishop. As shown below, the Queens 37*a* and 37*b* can move any number of squares horizontally, vertically, or diagonally that are vacant in the open playing field.

Figure 9:
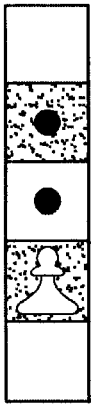
FIG. 9 is a diagram of the chessboard and the Pawn, showing movement of the Pawn on the chessboard, according to the present invention.
Figure 10:
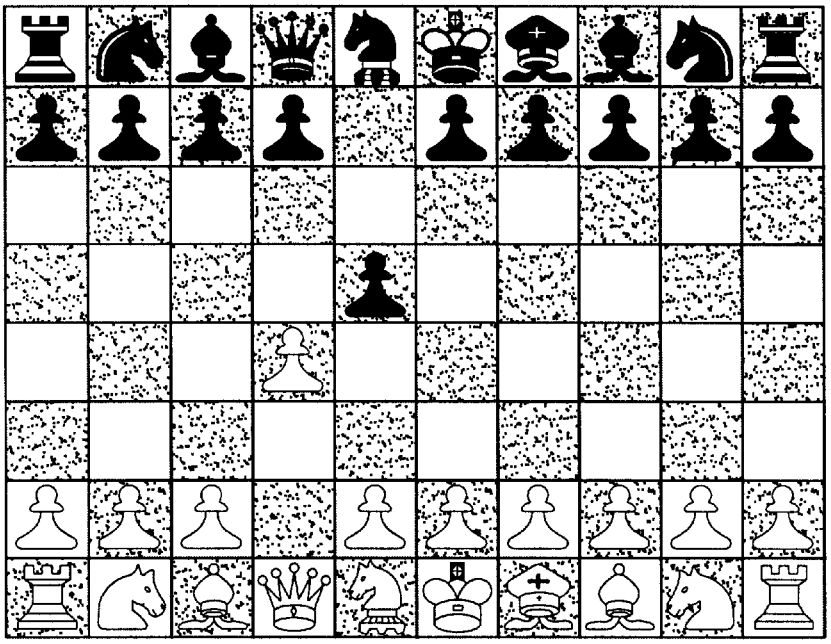
FIG. 10 is a diagram of the position on the chessboard before the white Pawn captures the black Pawn.
Figure 11:
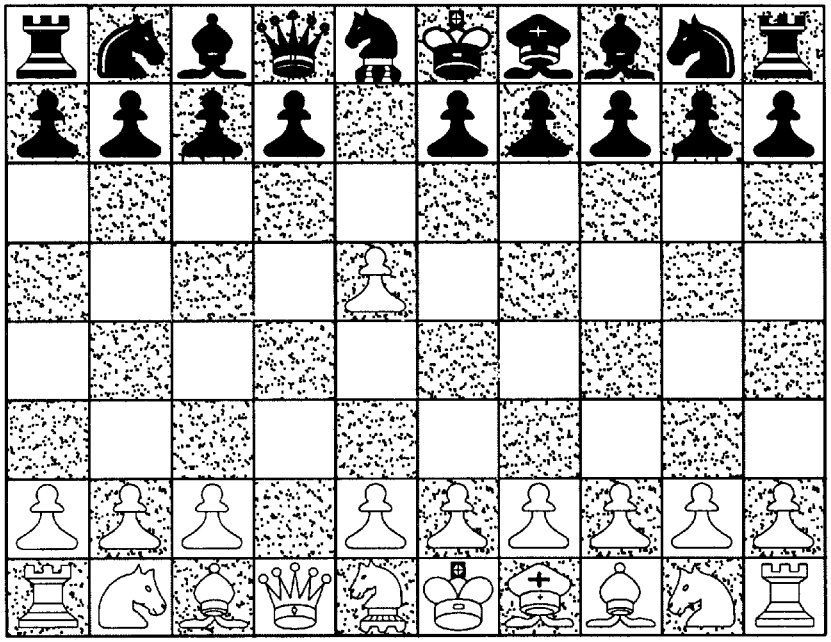
FIG. 11 is a diagram of the position on the chessboard after the white Pawn has captured the black Pawn.

FIG. 9 illustrates the movement of the Pawns 41*a*–41*t*, which move generally as conventional chess Pawns. The Pawns 41*a*–41*t* move only in the forward direction. On its first move only, the Pawns 41*a*–41*t* may be moved two squares, otherwise the Pawns 41*a*–41*t* may only move one square at a time. Pawns 41*a*–41*t* ate unique in that they capture by moving differently than their normal non-capturing advances. The pawns 41*a*–41*d* may capture any piece that is diagonally one square in front of it. FIG. 10 and FIG. 11 show the positions before and after the white pawn 41 d captures the black pawn 41 (o) respectively.

Figure 12:
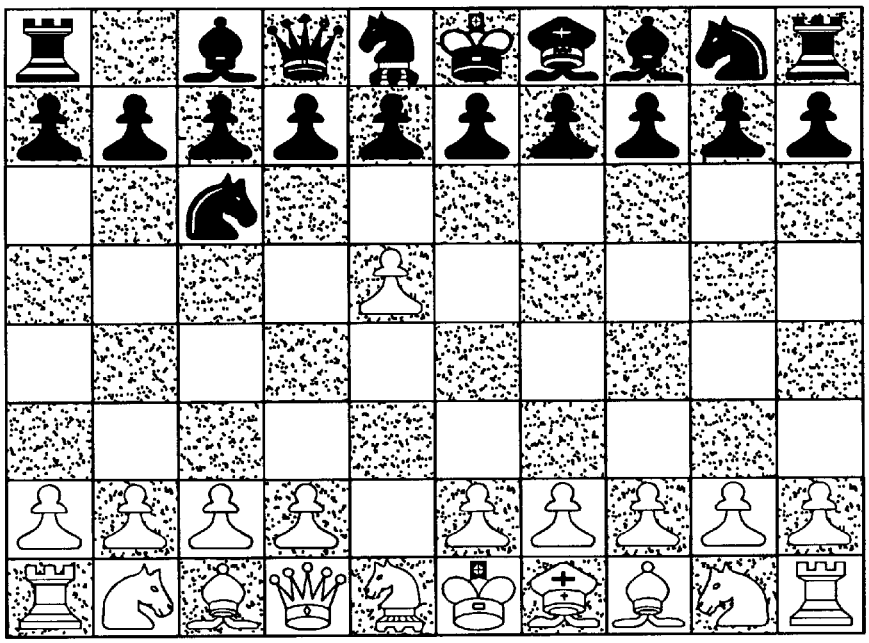
FIG. 12 is a diagram of a position of the chessboard showing the white Pawn after having moved three spaces before the en passant capture.
Figure 13:
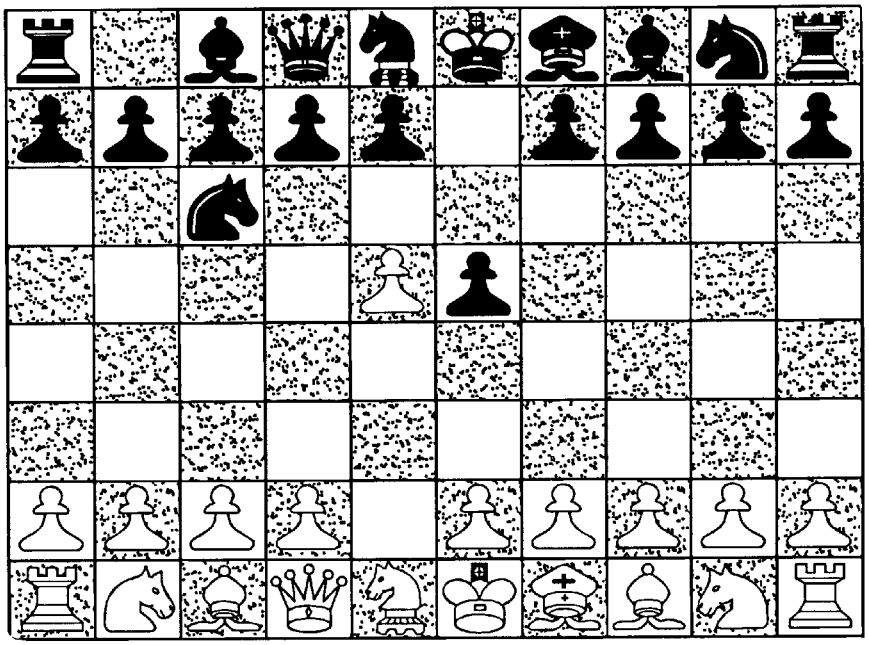
FIG. 13 is a diagram of the position of the chessboard after the black Pawn has moved two spaces on its first move before the en passant capture.
Figure 14:
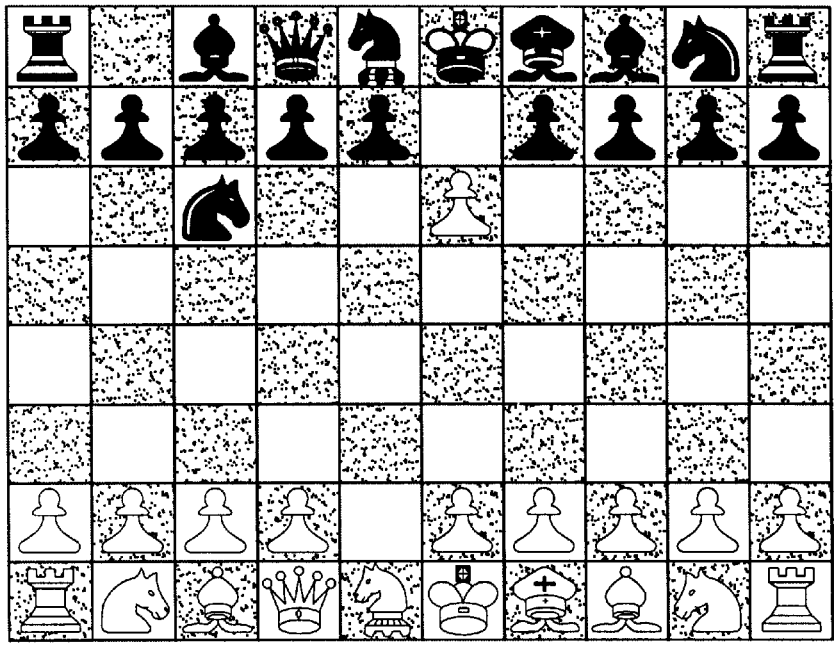
FIG. 14 is a diagram of the position of the chessboard after the en passant capture.

The Pawns 41*a*–41*t* may make a special type of capturing move referred to as en passant. If one of the white Pawns 41*e* has moved a total of three squares, and one of the black Pawns 41*p* lands next to it by evoking the option of moving two spaces on its first move, then the white Pawn 41*e* may, at the option of the player, remove the black Pawn 41*p* immediately. In this position, the white Pawn 41*e* treats the black Pawn 41*p* as if it moved only one square. The white Pawn 41*e* then executes a diagonal capture of the black Pawn 41*p*. FIG. 12 shows an initial position with white Pawn 41*e* having moved three spaces. FIG. 13 shows the position after the black Pawn 41*p* has elected to move two spaces on its first move. FIG. 14 shows the position after the en passant capture. It should be noted that the en passant capture can only be executed immediately after the opponent makes the Pawn move that allows it to occur. That is, if a player waives the option to make an en passant capture, his right to evoke it later is removed.

The Kings 40*a* and 40*b* are initially positioned toward the center of the board 12. The center of the board 12 is a dangerous location for the Kings 40*a* and 40*b* since the center of the board 12 is most vulnerable to attack. Attacking an opponents King 40*a* or 40*b* is one of the objects of the game. A special move called castling was devised to protect the Kings 40*a* and 40*b*. At an option of a player, a castling move may be made. Castling allows each of the Kings 40*a* and 40*b* and a corresponding one of the Rooks 32*a*, 32*b*, 32*c* or 32*d* to move on the same turn. Castling isolates the respective white or black King 40*a* or 40*b* from the center of the board 12. Castling can be performed "to either side" of the board 12.

A white King 40*a* castling side of the board 12 is designated by the squares (f–j)1. A white Queen 37*a* castling side of the board 12 is designated by the squares (a–e)1. Similarly, a black King 40*b* castling side of the board 12 is designated by the squares (f–j)8 and a black Queen 37*b* castling side of the board 12 is designated by the squares (a–e)8. After castling on the white King 40*a* side, the white King 40*a* is positioned at location (i)1 and the white King 40*a* side Rook 32*b* is positioned at location (g)1. After castling on the white Queen 37*a* side, the white King 40*a* is positioned at location (c)1 and the white Queen side rook 32*a* is positioned at location (d)1. Similarly, after castling on the black King 40*b* side, the black King 40*b* is positioned location (i)8 and the black King 40*b* side Rook 32*d* is positioned at location (h)8. Further, after castling on the black Queen 37*b* side, the black King 40*b* is positioned location (c)8 and the black King 40*b* side Rook 32*c* is positioned at location (d)8.

Figure 15:
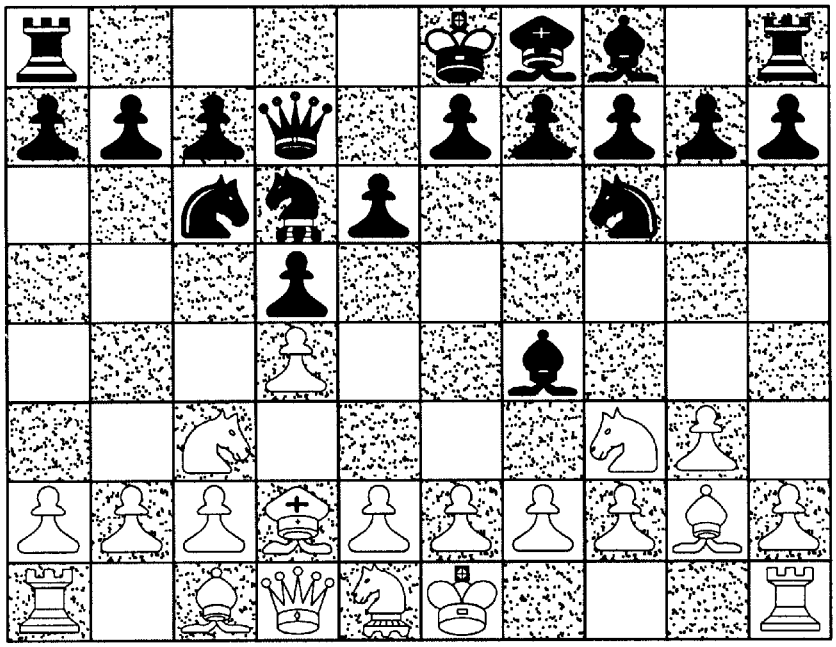
FIG. 15 is a diagram of the position of the chessboard before white castles on the King side.
Figure 16:
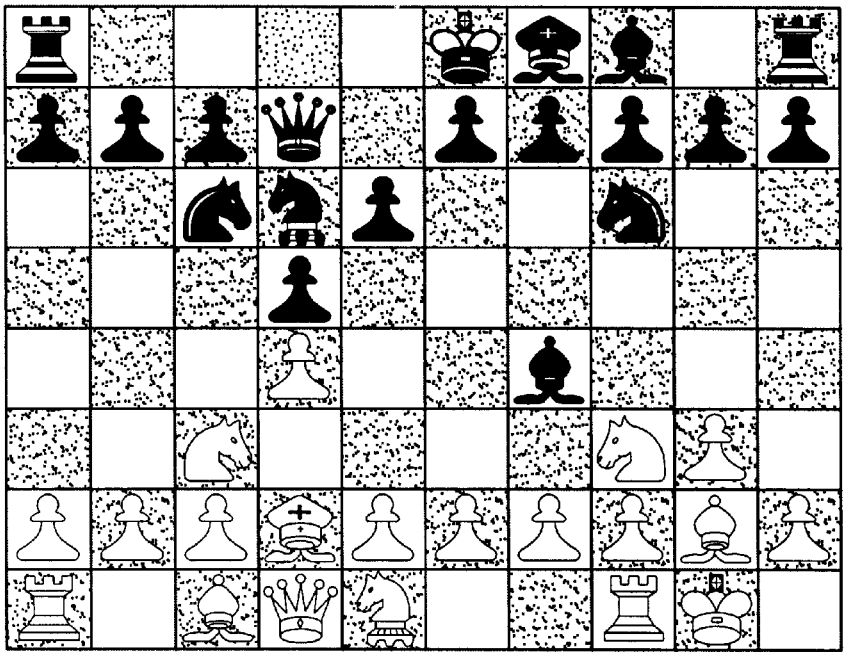
FIG. 16 is a diagram of the position of the chessboard after white has castled on the King side.

In order for one of the Kings 40*a* or 40*b* to enjoy the privilege of castling, the respective King 40*a* or 40*b* must not have moved previously. The same rule applies to the corresponding one of the white Rooks 32*a* or 32*b* or black Rooks 32*c* or 32*d* that participates in the castle. Castling also requires that no pieces lie on the squares between the respective King 40*a* or 40*b* and the corresponding white Rooks 32*a* or 32*b* or black Rooks 32*c* or 32*d* that will participate in the move. For example, FIG. 15 shows the position of the board 12 before the white King 40*a* and white Rook 32*b* castle on the white King 40*a* side. Squares g1, h1 and i1 must be clear before castling may occur on the white King 40*a*. As shown in FIG. 16, the castling move allows the white King 40*a* to move three squares horizontally, after which the Rook 32*b* is placed on the "other side of" the white King 40*a*. Similarly, squares b1, c1, d1 and e1 must be clear before castling can occur on the white Queen 37*a* side. Further, squares g8, h8 and i8 must be clear before castling may occur on the black King 40*b* side and squares b8, c8, d8 and e8 must be clear before castling may occur on the black Queen 37*b* side.

Figure 17:
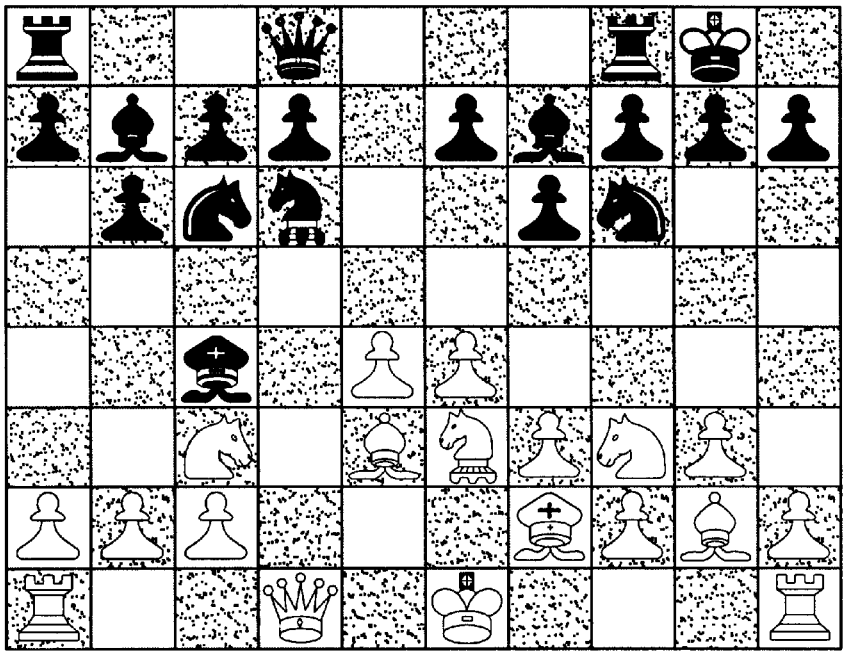
FIG. 17 is a diagram of the position of the chessboard showing the white King under attack.

Further, prior to a castling move, the Kings 40*a* or 40*b* may not be in check or attacked by any enemy piece. The white King 40*a*, as shown in FIG. 17, is under attack by the black Archbishop 39*b*. The castling move may not be made by the white King 40*a* and white Rook 32*b* while the white King 40*a* is under attack. The white King 40*a* may not perform the castling move until either the black Archbishop 39*b* moves away from its position of attack or a white piece blocks the diagonal of attack by the Archbishop 39*b*.

Figure 18:
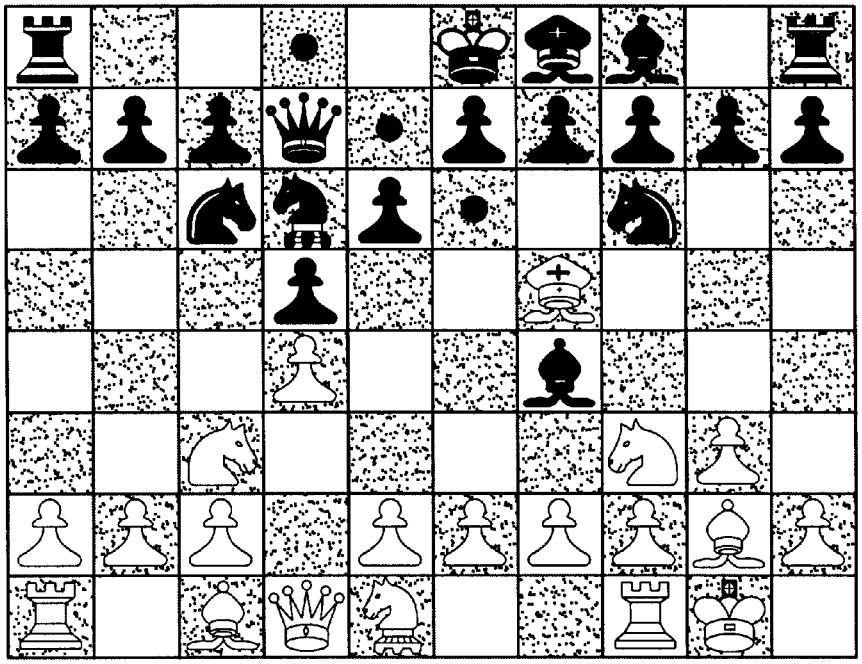
FIG. 18 is diagram of the position of the chessboard showing the black King being unable to castle.

A final criteria for castling stipulates that each of the squares the respective King 40*a* or 40*b* journeys over, must also not be under attack by the opponent. As shown in FIG. 18 the black King 40*b* may not perform the castle move, even though no pieces are between the black King 40*b* and the Rook 32*c*. This is because the white Archbishop 39*a* is attacking one of the squares the black King 40*b* must cross in order to complete the castling move. The black King 40*b* may not perform the castling move until either the white Archbishop 39*a* moves away from its position of attack or a black piece blocks the diagonal of attack to the black King 40*b* by the white Archbishop 39*a*.

Figure 19:
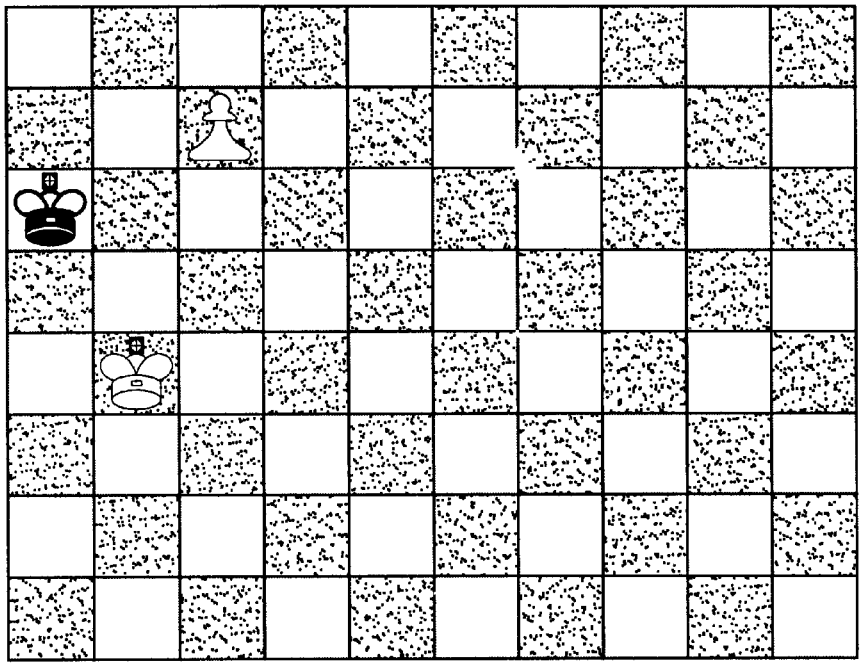
FIG. 19 is a diagram of the position of the chessboard showing the white Pawn ready to be promoted on its next move.

Should one of the white Pawns 41*a*–41*j* or black Pawns 41*k*–41*t* complete the trek to the opposite row 26*h* or 26*a* respectively of the board 12, it can become "promoted" to become a higher ranking piece. FIG. 19 shows a position where the white Pawn 41*c* is ready to be promoted on its next move. The White Pawns 41*a*–41*j* or black Pawns 41*k*–41*t* may be promoted to any piece except a white King 40*a* or black King 40*b* and or another respective white Pawn 41*a*–41*j* or black Pawn 41*k*–41*t*. There is no limit to the number of similar pieces on the board 12. For example, even if a player has one white Queen 37*a* on the board 12, a subsequent promotion to a second white Queen 37*a*, is still allowed. This rule holds true for the black pieces 31 as well.

Figure 20:
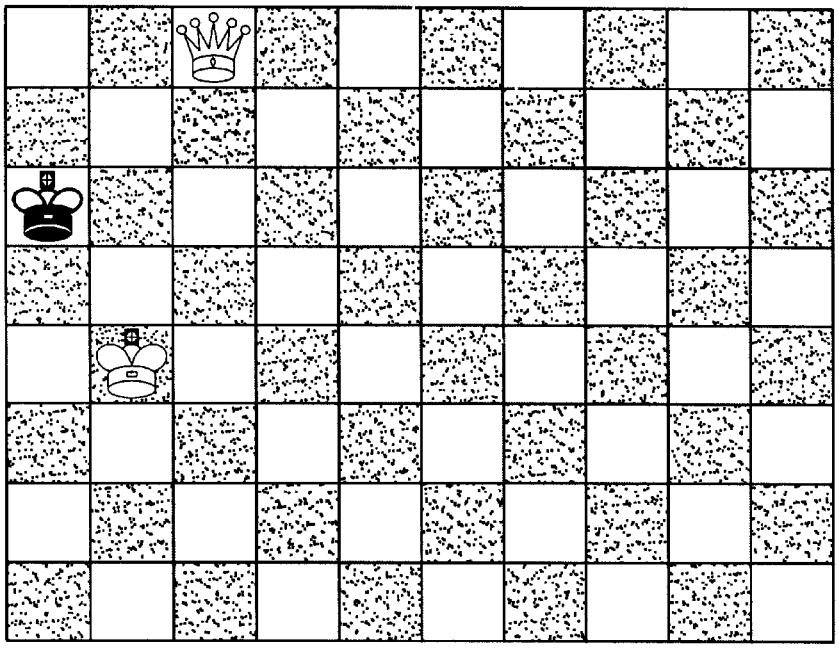
FIG. 20 is a diagram of the position of the chessboard showing the Pawn having been promoted to a Queen.

In most instances, a white Pawn 41*a*–41*j* will be promoted to a white Queen 37*a* and a black Pawn 41*k*–41*t* will be promoted to a black Queen 37*b*. The white Queen 37*a* and black Queen 37*b* are generally felt to be the most powerful pieces on the chessboard 12. FIG. 20 shows the position of the chessboard 12 after the white Pawn 41*c* has been promoted to Queen 37*a*. Promoting the white Pawn 41*c* to Queen 37*a* delivers a check. The opponent that is in check has limited options. Once in check, the next move must not leave the player in check. Such a move is illegal. If a player commits an illegal move, the move is "undone", the player is still in check, and that player must then move out of check. As shown in FIG. 20, the newly promoted white Queen 37*a* is attacking the black King 40*b*. Recall that the Queen 37*a* has the diagonal attacking power of a Bishop and the horizontal and vertical attacking arrays of a Rook. The black King 40*b* cannot move vertically down, since the Kings 40*a* and 40*b* are not allowed to be next to one another. The black King 40*b* can, however, move up or to the right. The black King 40*b* can still move to a new square without being under attack therefore, the game is not over.

Figure 21:
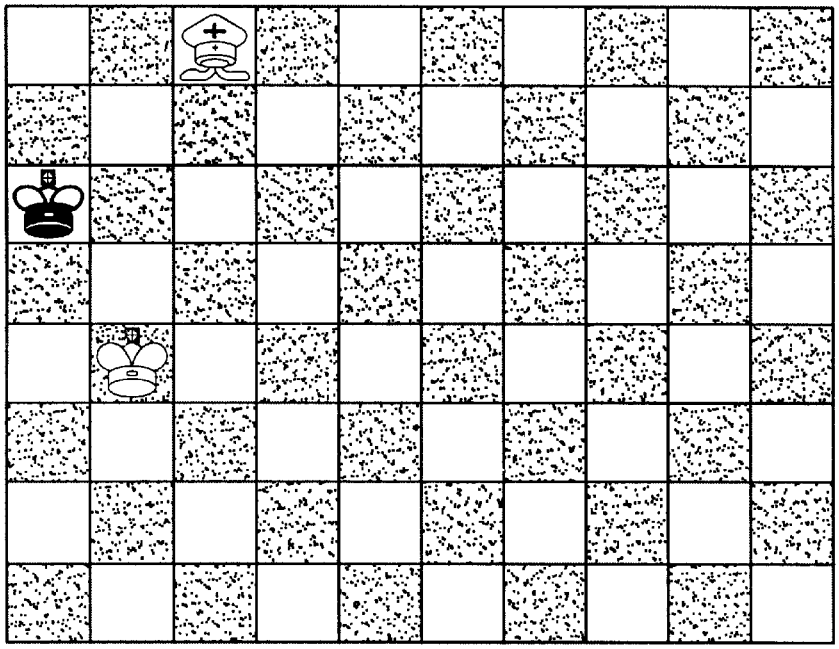
FIG. 21 is a diagram of the position of the chessboard showing the Pawn having been promoted to an Archbishop.

FIG. 21 shows the position of the chessboard 12 after the Pawn 41*c* has been promoted to an Archbishop 39*a*. In this case, promoting the Pawn 41*c* to an Archbishop 39*a* ends the game. The black King 40*b* is under attack and has no place to move without still being under attack. As shown in FIG. 21, the newly promoted Archbishop 39*a* is attacking the black King 40*b* using its diagonal Bishop attack. The black King 40*b* cannot move down, since that would place it next to the white King 40*a*, which is illegal. The black King 40*b* cannot move to the right or up, since the Knight component attack of the Archbishop 39*a* denies those as legal retreat squares. Moving right or vertically up would be a move into check, which is illegal. The black King 40*b* is also denied a diagonal move towards the Archbishop 39*a*, since the diagonal attack of the Archbishop 39*a* makes such a move illegal. Therefore the black King 40*b* cannot make a legal move out of check. This condition whereby the black King 40*b* cannot make a legal move out of check is called checkmate and the game is over.

Figure 22:
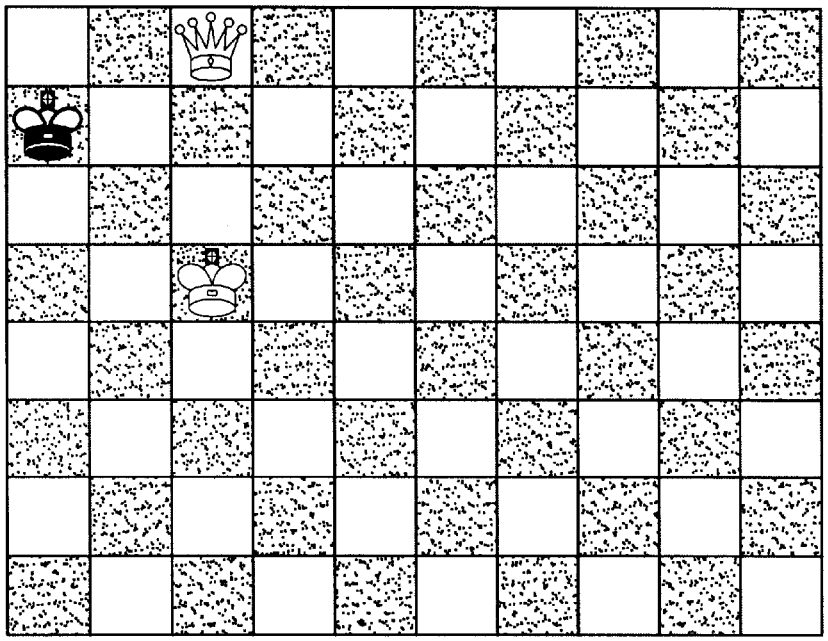
FIG. 22 is a diagram of the position of the chessboard where the black King is to move but, the game is a stalemate since the black King has no legal moves.
Figure 23:
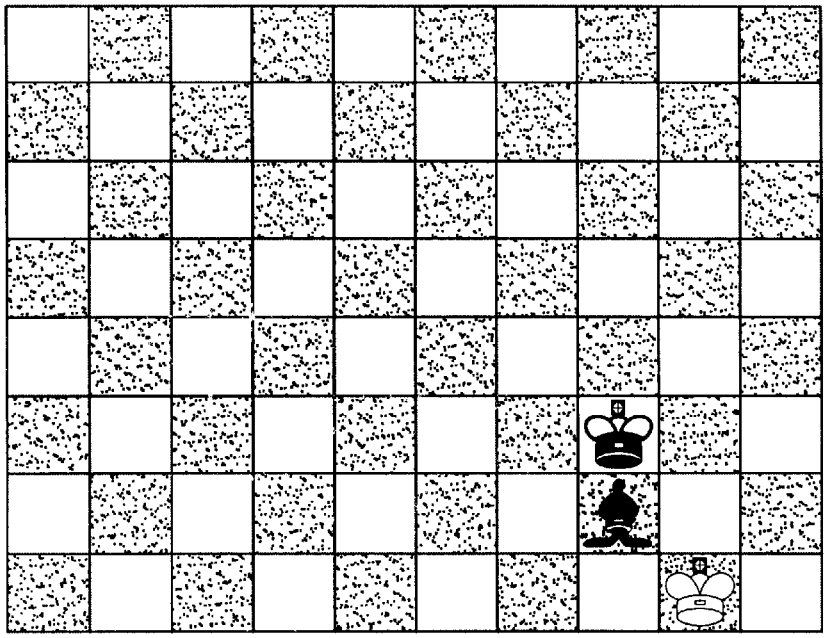
FIG. 23 is a diagram of the position of the chessboard where one white Knight or Bishop cannot force checkmate and the position ends in a stalemate.

If a player has no legal moves, yet is not in check, the game ends in what is termed a stalemate. A stalemate condition is a draw. FIG. 22 shows a position on the board 12 where the black King 40*b* is to move. The game is a stalemate since the black King 40*b* has no legal moves. There are also conditions where it is impossible to force a checkmate. For example, as shown in FIG. 23, one black Bishop 36*d* cannot force checkmate. For that reason, the position as shown would be declared a draw. There are other situations in which the game is declared a draw. Should 50 moves elapse without a Pawn 41*a*–41*t* being moved, any white 30 or black piece 31 being captured, or a castling move being executed, the game is drawn by a "50 Move Rule." Also, should the same position occur with the same side to move for a third time (not necessarily consecutive) a "Repetition of Position" draw is announced.

While the principles of the invention have been described above in connection with the specific associated method, it is to be clearly understood that this description is made only by way of example and not as a limitation on the scope of the invention.

What is claimed is:

1. A method of playing a variant of chess comprising the steps of:

providing a rectangular chessboard having 80 contiguous playing squares disposed thereon, wherein the rectangular board includes two player edges being opposite each other and two non-player edges being adjacent to the two player edges, wherein a–j contiguous columns are aligned along each of the player edges and 1–8 contiguous rows are aligned along each of the two non-player edges;

providing a plurality of conventional chess pieces that include two rooks, two bishops, two knights, a king, a queen, and eight pawns for each player;

providing a plurality of non-conventional pieces that include a chancellor, an archbishop, and two additional pawns for each player;

initially locating the conventional and non-conventional pieces on two rows of the rectangular chess board that are disposed most proximate to each of the two player edges, wherein the rooks are located at column and row positions a1, j1, a8, and j8 respectively, the knights are located at positions b1, i1, b8, and i8 respectively, the bishops are located at positions c1, h1, c8, and h8 respectively, the queens are located at positions d1, d8 respectively, the chancellors are located at e1, e8 respectively, the kings are located at positions f1, f8 respectively, the archbishops are located at positions g1, g8 respectively, and the pawns are located at positions (a–j)2, (a–j)7 respectively;

wherein, after the initially locating step, each chancellor may be moved, at an option of a player, as either a conventional knight, or a conventional rook; and wherein, after the initially locating step, each archbishop may be moved, at an option of a player, as a conventional knight or a conventional bishop.

2. The method according to claim 1, wherein a color is associated with the pieces initially positioned on squares (a–j)1 and (a–j)2.

3. The method according to claim 2, wherein a color is associated with the pieces initially positioned on squares (a–j)7 and (a–j)8.

4. The method according to claim 3, wherein the color associated with the pieces initially positioned on squares (a–j)1 and (a–j)2 is white.

5. The method according to claim 4, wherein the color associated with the pieces initially positioned on squares (a–j)7 and (a–j)8 is black.

6. The method according to claim 5, wherein after the initially locating step, at the option of a player, a castling move may be performed by a king and a rook.

7. The method according to claim 6, wherein a white king castling side of the board is designated by the squares (f–j)1, and a white queen castling side of the board is designated by the squares (a–e)1.

8. The method according to claim 7, wherein, a black king castling side of the board is designated by the squares (f–j)8, and a black queen castling side of the board is designated by the squares (a–e)8.

9. The method according to claim 8, wherein after castling on the white king side, the white king is positioned at location (i)1 and the white king side (j)1 rook is positioned at location (g)1.

10. The method according to claim 8, wherein after castling on the white queen side, the white king is positioned at location (c)1 and the white queen side (a)1 rook is positioned at location (d)1.

11. The method according to claim 8, wherein after castling on the black king side, the black king is positioned at location (i)8 and the black king side (j)8 rook is positioned at location (h)8.

12. The method according to claim 8, wherein after castling on the black queen side, the black king is positioned at location (c)8 and the black king side (a)8 rook is positioned at location (d)8.

13. The method according to claim 6, wherein prior to castling, neither the king, nor the rook, may have made a prior move.

14. The method according to claim 6, wherein prior to castling, the pieces initially positioned in the squares spaced between the king and the rook to be castled, must be moved, thus providing a clear path between the king and the rook.

15. The method according to claim 1, wherein a pawn may be advanced to an opposing players edge of the board.

16. The method according to claim 15, wherein when the pawn is advanced to an opposing player's edge, the pawn is entitled to be promoted.

17. The method according to claim 16, wherein upon promotion of the pawn, the player whose pawn has been promoted, may choose a rook, knight, bishop, queen, archbishop, or chancellor of his own color to replace the pawn.

* * * * *